US006840789B2

(12) United States Patent
Shibata

(10) Patent No.: US 6,840,789 B2
(45) Date of Patent: Jan. 11, 2005

(54) CONNECTOR AND A METHOD OF ASSEMBLING IT

(75) Inventor: Takahiro Shibata, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/717,858

(22) Filed: Nov. 19, 2003

(65) Prior Publication Data

US 2004/0102077 A1 May 27, 2004

(30) Foreign Application Priority Data

Nov. 19, 2002 (JP) ..... 2002-335250

(51) Int. Cl.[7] ..... H01R 13/627
(52) U.S. Cl. ..... 439/345; 439/354; 439/374
(58) Field of Search ..... 439/374, 299, 439/345, 350, 354, 357, 370

(56) References Cited

U.S. PATENT DOCUMENTS 5,389,006 A * 2/1995 Noschese ..... 439/354
5,711,684 A * 1/1998 Inoue et al. ..... 439/354
6,416,346 B1 7/2002 Nakamura ..... 439/374

FOREIGN PATENT DOCUMENTS

EP 615315 A2 * 9/1994 ..... 439/345
GB 2195501 A * 4/1988 ..... 439/370
JP 2002-25696 1/2002

* cited by examiner

*Primary Examiner*—Renee Luebke
(74) *Attorney, Agent, or Firm*—Gerald E. Hespos; Anthony J. Casella

(57) ABSTRACT

A female housing (20) includes a terminal-accommodating portion (21) adapted to accommodate female terminal fittings (29) and having different vertical and horizontal dimensions. A lock (31) is provided on a shorter outer surface (21D) of the terminal-accommodating portion (21). Connection guides (50) are formed in inner surfaces of a receptacle (12) of a male housing (10) and extend in an inserting direction of the terminal-accommodating portion (21). Guidable portions (70) are formed on outer surfaces of the terminal-accommodating portion (21) of the female housing (20) for sliding contact with the connection guides (50) when the terminal-accommodating portion (21) is fit into the receptacle (12).

6 Claims, 9 Drawing Sheets

CONNECTOR AND A METHOD OF ASSEMBLING IT

BACKGROUND OF THE INVENTION

1. Field of the Invention

The invention relates to a connector with an inertial locking mechanism and to a method of assembling it.

2. Description of the Related Art

Connectors with an inertial locking mechanism are disclosed in Japanese Unexamined Patent Publication No. 2002-25696 and in FIG. 9 herein. With reference to FIG. 9, the connector has a waiting-side male housing 2 to be mounted on a panel 1 and an assembling-side female housing 3 to be connected with the male housing 2. The female housing 3 has a terminal-accommodating portion 4 with a substantially rectangular cross section and the male housing 2 has a receptacle 5 for receiving the terminal-accommodating portion 4. Female terminal fittings (not shown) are accommodated in the terminal accommodating portion 4 and male terminal fittings 6 project into the receptacle 5. The male terminal fittings 6 and the female terminal fittings are connected electrically with each other by fitting the terminal-accommodating portion 4 into the receptacle 5. The terminal-accommodating portion 4 has shorter sides 7 and lock arms 8 project forward at the outer surfaces of the shorter sides 7. Each lock arm 8 has a substantially rectangular projection 9 that contacts the front-end surface of the receptacle 5 during connection of the housings 2, 3, thereby restricting the connecting operation. The two housings 2, 3 are connected properly in a single stroke due to the action of inertia by exerting a connecting force larger than a frictional resistance between the mating terminal fittings in the process of properly connecting the two housings 2, 3. This can prevent the two housings 2, 3 from being left partly connected.

The projection 9 of the lock arm 8 contacts the front-end surface of the receptacle 5, and a shorter side 7 of the terminal-accommodating portion 4 where the lock arm 9 is provided is temporarily prevented from entering the receptacle 5. Thus, the female housing 3 may incline, as shown in FIG. 9, and there is a possibility that the successive connecting operation will not proceed smoothly.

The present invention was developed in view of the above problem and an object thereof is to provide smooth a connecting operation of a connector that has an inertial locking mechanism.

SUMMARY OF THE INVENTION

The invention relates a connector with a first housing that has a terminal-accommodating portion for accommodating terminal fittings. The terminal-accommodating portion has different length and width dimensions. At least one lock is provided on a shorter outer surface of the terminal-accommodating portion. The connector also has a second housing with a receptacle into which the terminal-accommodating portion can fit. Mating terminal fittings in the second housing are connectable with the terminal fittings in the first housing. The second housing has an engaging portion engageable with the lock when the terminal-accommodating portion is fit into the receptacle. At least one connection guide is formed on an inner surface of the receptacle of the second housing and extends in a mating direction of the terminal-accommodating portion. At least one guidable portion is formed on an outer surface of the terminal-accommodating portion of the first housing and is brought into sliding contact with the connection guide when the terminal-accommodating portion is fit into the receptacle.

The mating terminal fittings preferably are arranged so that leading ends thereof project into the receptacle.

The first housing preferably can be pushed into the second housing while the lock cooperates with the engaging portion. The first housing reaches a connection position by an inertial force when the terminal-accommodating portion is pushed a specified distance.

The first housing preferably is locked with the second housing by the engagement of the lock with the rear surface of the engaging portion.

The lock is on the shorter side of the outer surfaces of the terminal-accommodating portion, and the first and second housings reach the connection position due to the inertial locking of the lock. Thus, the first housing may incline in the connecting process. However, the guidable portion and the connection guide engage and are held in sliding contact. Thus, the inclination of the first connector housing resulting from the inertial locking can be corrected immediately. As a result, the first housing smoothly reaches the connection position while keeping its proper posture.

At least one rib preferably projects on a shorter side of the outer surfaces of the terminal-accommodating portion opposite from the shorter side that has the lock. The rib is designed to avoid the contact of the front end of the terminal-accommodating portion with the leading ends of the mating terminal fittings in the receptacle due to an interference of the front end of the rib with an opening edge of the receptacle. Thus, the front end of the terminal-accommodating portion will not deform the leading ends of the mating terminal fittings, and the contact reliability is assured.

The at least one guidable portion preferably is formed on at least one of the longer sides of the terminal-accommodating portion.

The leading end of the at least one rib and/or the at least one guidable portion may be at a front end of the receptacle. Thus, the ribs and/or the guidable portions are engageable with corresponding engaging grooves and/or corresponding connection guiding portions before the lock contacts the engaging portion in the connecting process.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to, FIGS. 1 to 8. This connector has a waiting-side male housing 10 to be mounted on a panel P, such as a door of an automotive vehicle. The connector also has an assembling-side female housing 20 connectable along a connecting direction CD with the male housing 10. In the following description, sides of the male and female housings 10, 20 to be connected are referred to as the front.

Figure 5:
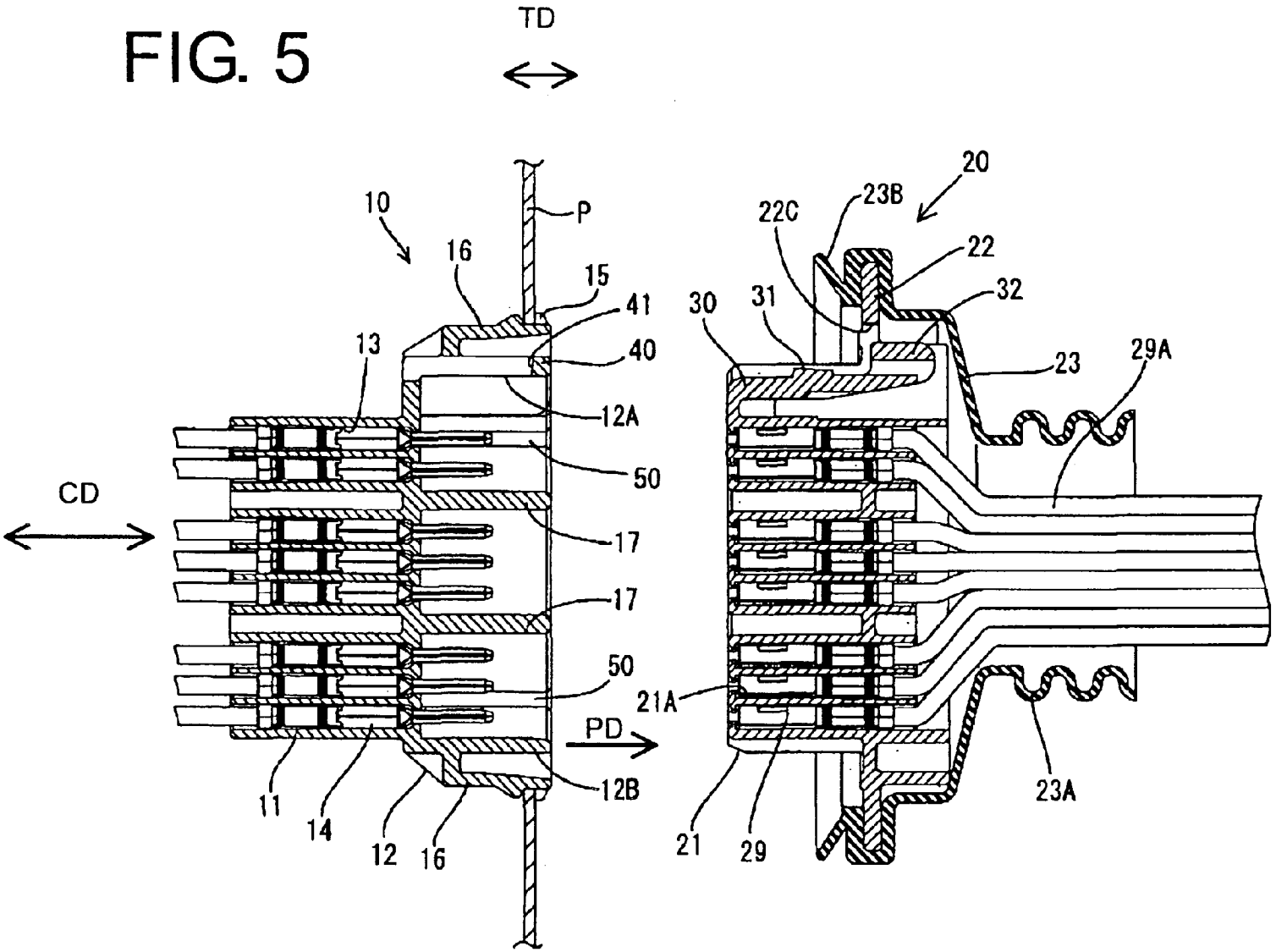
FIG. 5 is a section showing a state before the male and female housings are connected.

The male housing 10 has a tall main body 11 and a tall receptacle 12 projects forward from the main body 11. Cavities 13 are formed inside the main body and, as shown in FIG. 5, accommodate male terminal fittings 14 so that the leading ends of the male terminal fittings 14 project into the receptacle 12.

Figure 1:
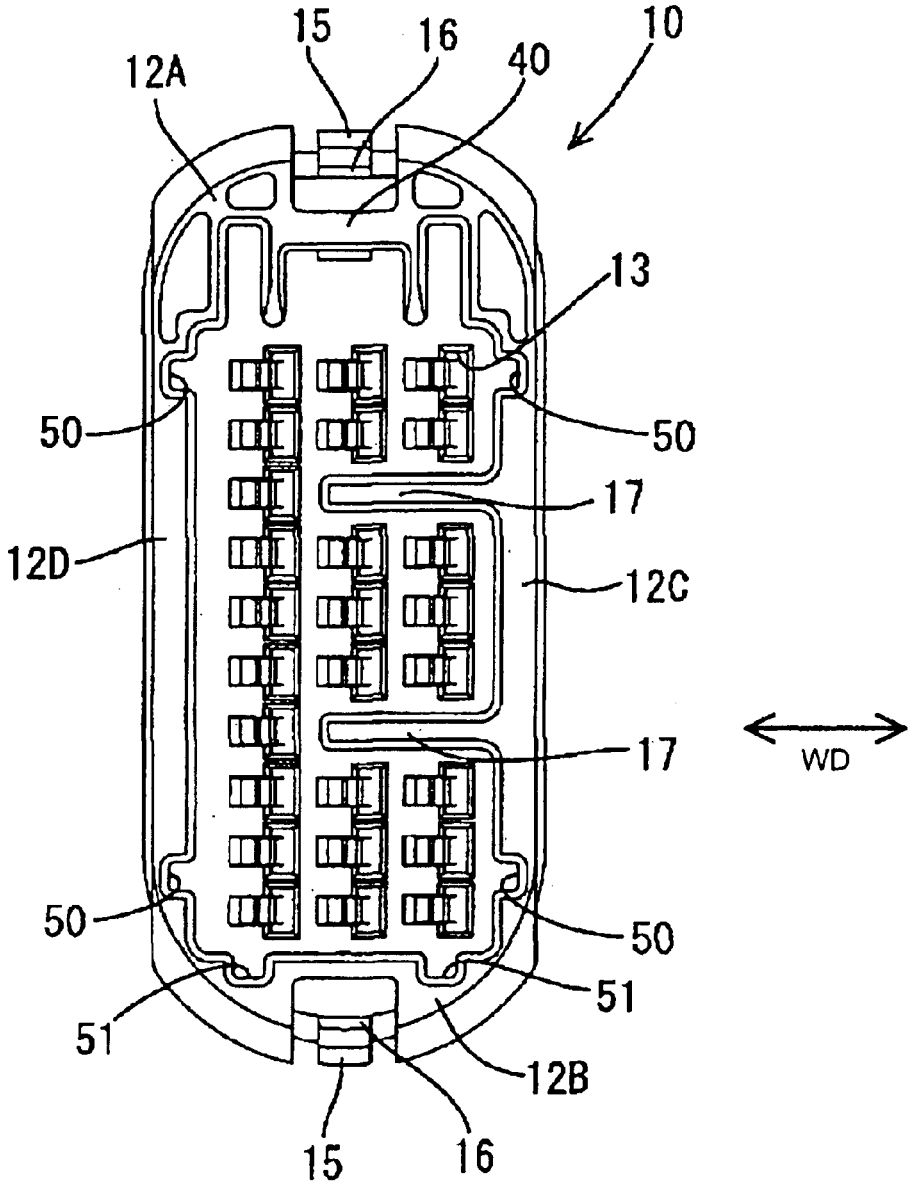
FIG. 1 is a front view of a male housing of a connector according to one embodiment of the invention.
Figure 2:
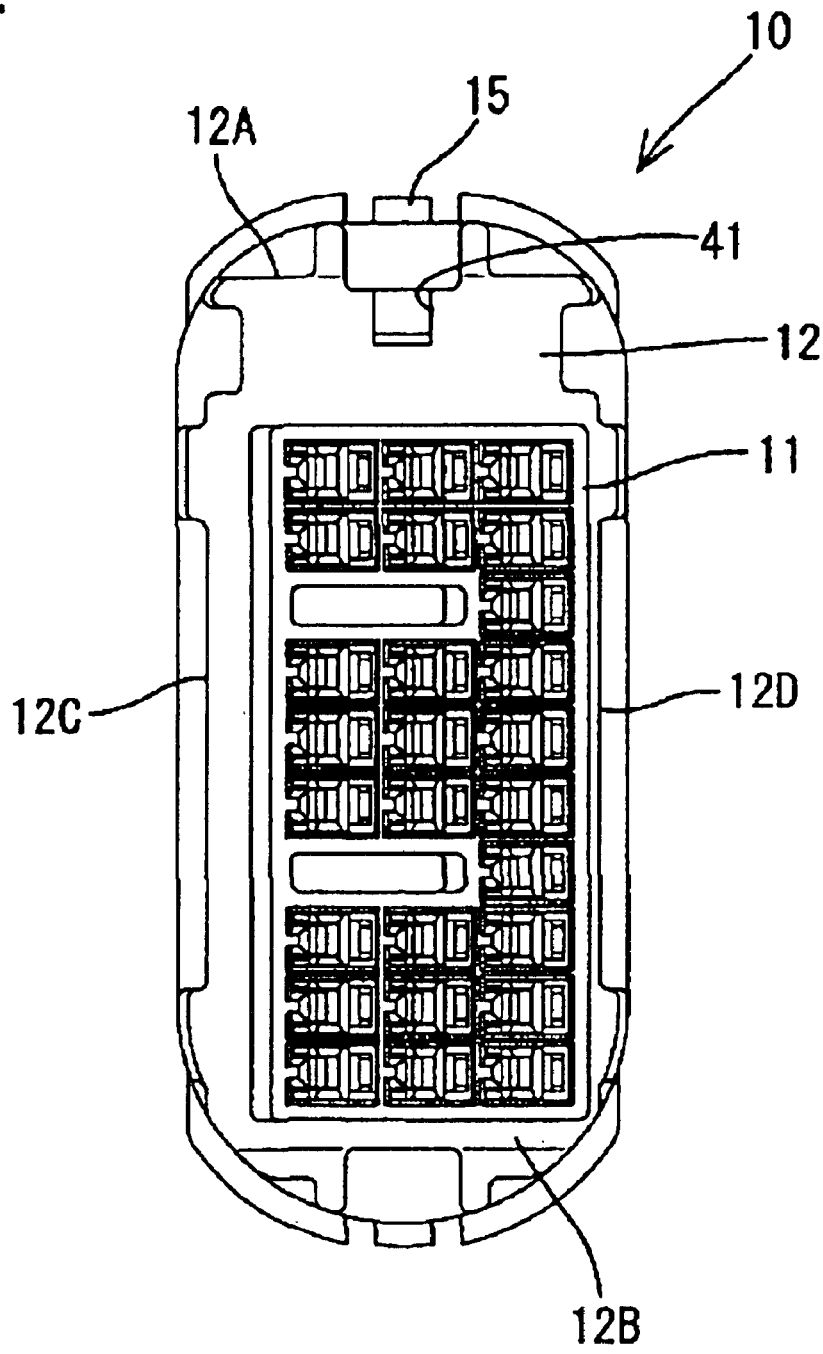
FIG. 2 is a rear view of the male housing.

The male housing 10 is fit to a mount opening in a panel P from behind the panel P and is secured to the panel P by upper and lower locking claws 15. As shown in FIG. 1, each locking claw 15 has a claw for tightly holding the panel P in a thickness direction TD. The locking claws 15 are formed at the leading ends of resilient pieces 16 substantially at widthwise-middle positions of upper and lower walls 12A, 12B of the receptacle 12. An engaging portion 40 is forming at the opening edge of the receptacle 12 at a position on the upper wall 12A of the receptacle 12 substantially facing the locking claw 15 in the deforming direction of the locking claw 15. A long locking hole 41 is formed in the upper wall 12A of the receptacle 12 behind the engaging portion 40 as seen along a connecting direction CD, and one end thereof is open in the rear surface of the receptacle 12 (see FIGS. 2 and 6).

The receptacle 12 has left and right vertically tall side walls 12C, 12D, as shown in FIG. 1. Two plate-shaped shelves 17 project in substantially along the widthwise direction WD from the side wall 12C to partly cross the receptacle 12. The shelves 17 are substantially parallel and are at vertically spaced positions on the side wall 12C of the receptacle 12. Additionally, the shelves 17 extend from the front end of the receptacle 12 to the rear end thereof.

Connection guides 50 are formed on inner surfaces of the receptacle 12 for guiding the female housing 20 to a proper connection position. The connection guides 50 are grooves in the inner surfaces of the opposite side walls 12C, 12D of the receptacle 12 and extend along a projecting direction PD of the receptacle 12 between the opening edge of the receptacle 12 and the back end surface thereof. The connection guides 50 are formed in the inner surfaces of the side walls 12C, 12D at a position near the upper wall 12A and at a position near the bottom wall 12B so as to substantially face each other between the side walls 12C, 12D. Further, engaging grooves 51 are formed at two widthwise end positions of the inner surface of the bottom wall 12B of the receptacle 12 to be substantially parallel with the connection guides 50.

The female housing 20, as shown in FIG. 5, has a terminal-accommodating portion 21 with cavities 21A that receive female terminal fittings 29. A jaw 22 bulges out from outer periphery of the terminal-accommodating portion 21 near the rear end.

Figure 7:
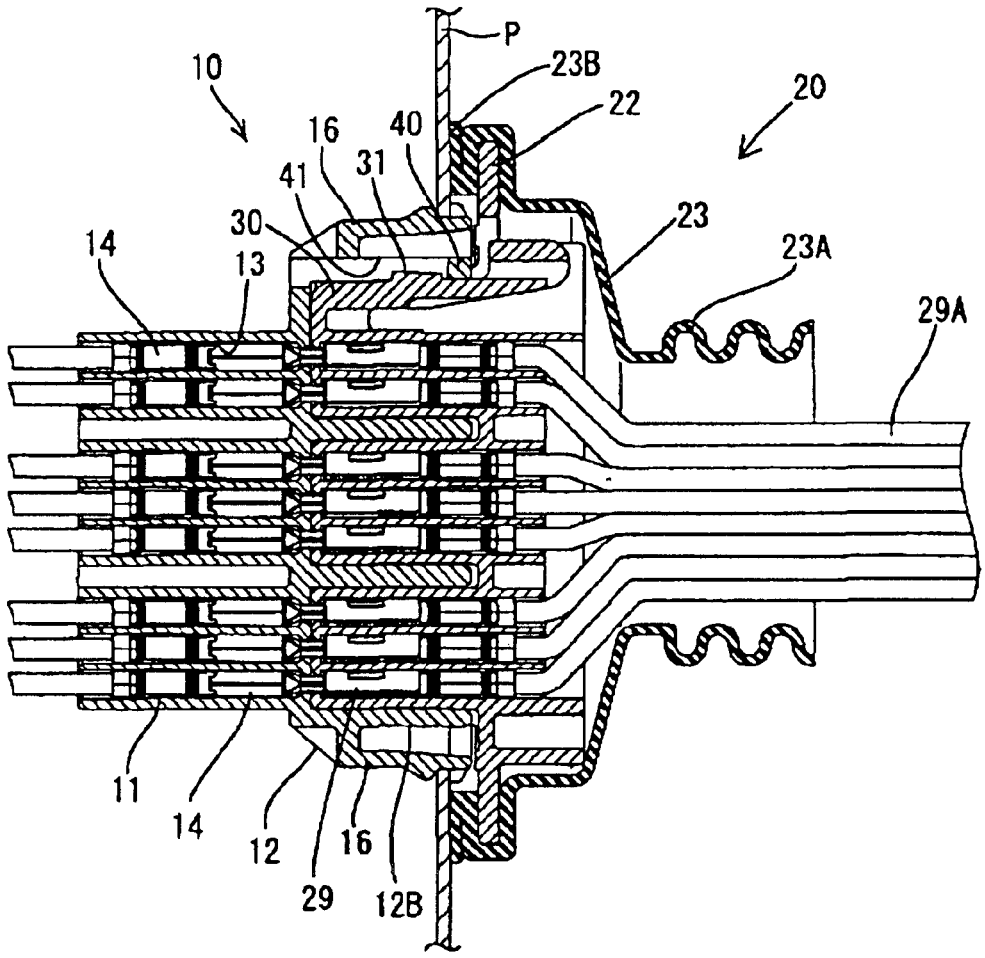
FIG. 7 is a section showing a state where the male and female housings are at a connection position.
Figure 8:
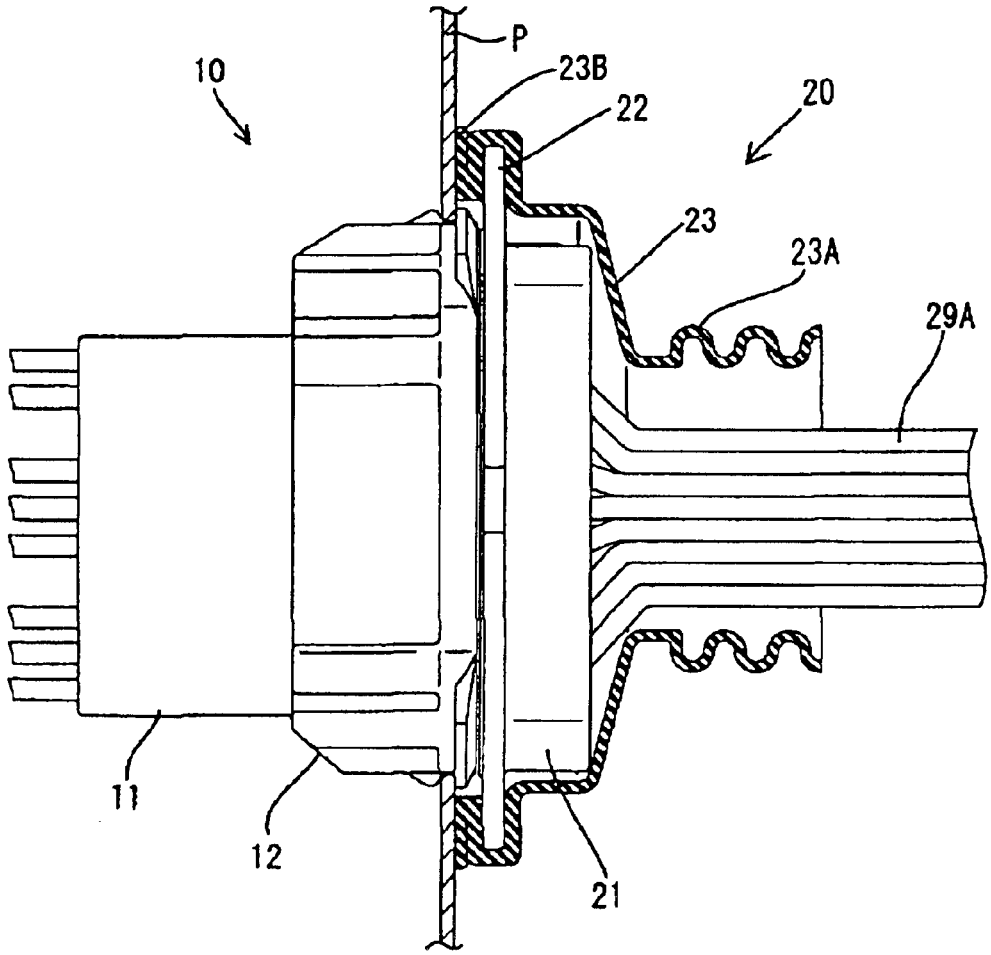
FIG. 8 is a side view showing the state of FIG. 7.
Figure 9:
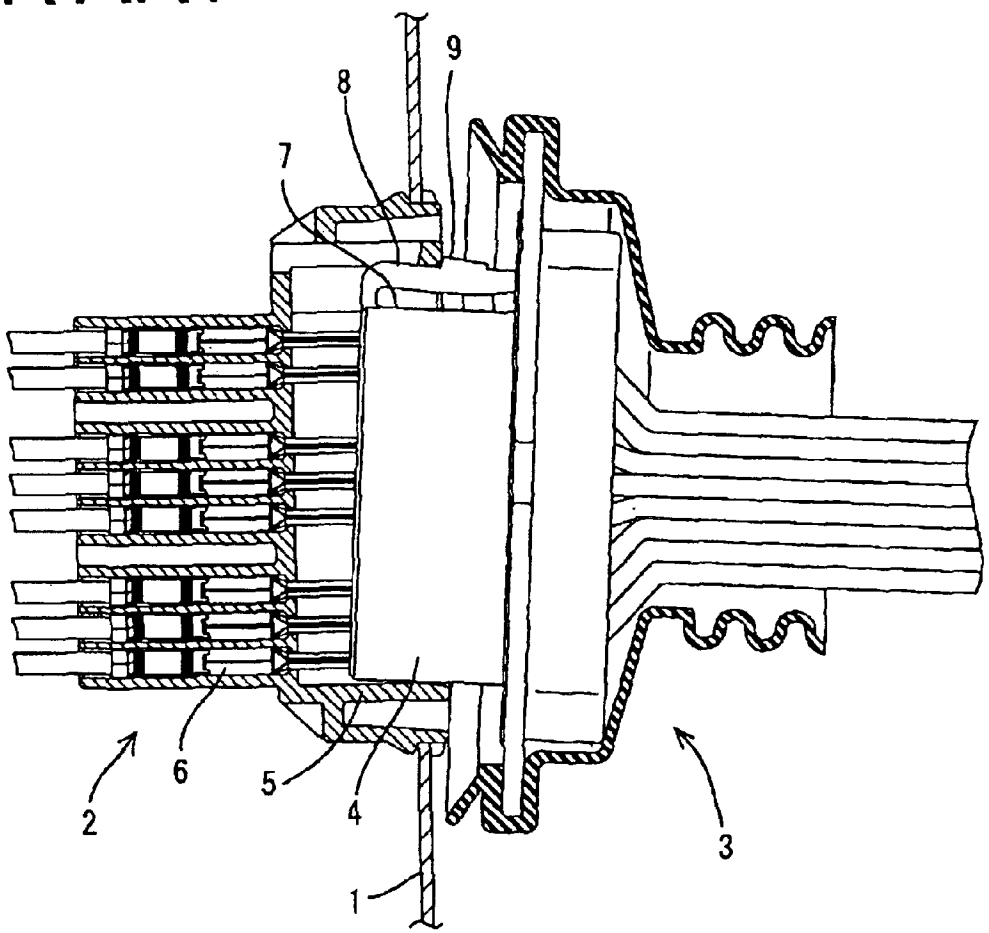
FIG. 9 PRIOR ART
FIG. 9 is a section showing a prior art connector.

A grommet 23 is mounted on the female housing 20 by being attached to the jaw 22 from behind. A wire draw-out portion 23A is formed at the rear end of the grommet 23 substantially surrounding the terminal accommodating portion 21 for receiving wires 29A drawn out from the terminal accommodating portion 21. The grommet 23 also has a sealing portion 23B that diverges toward the front. The sealing portion 23B can be held in close contact with the panel P, as shown in FIG. 7, when the female housing 20 is connected with the male housing 10 to secure watertightness of the connector.

Figure 3:
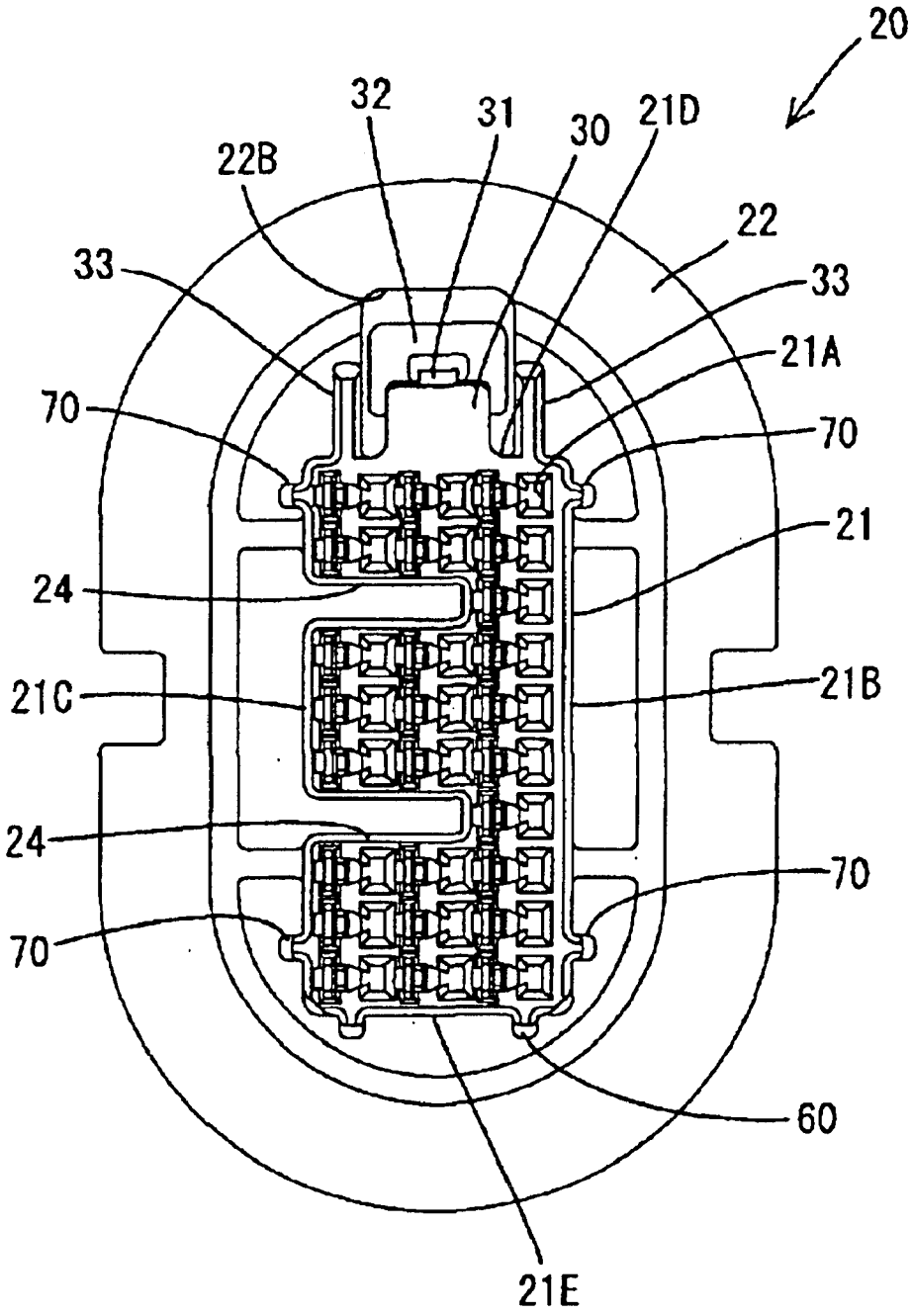
FIG. 3 is a front view of a female housing.
Figure 4:
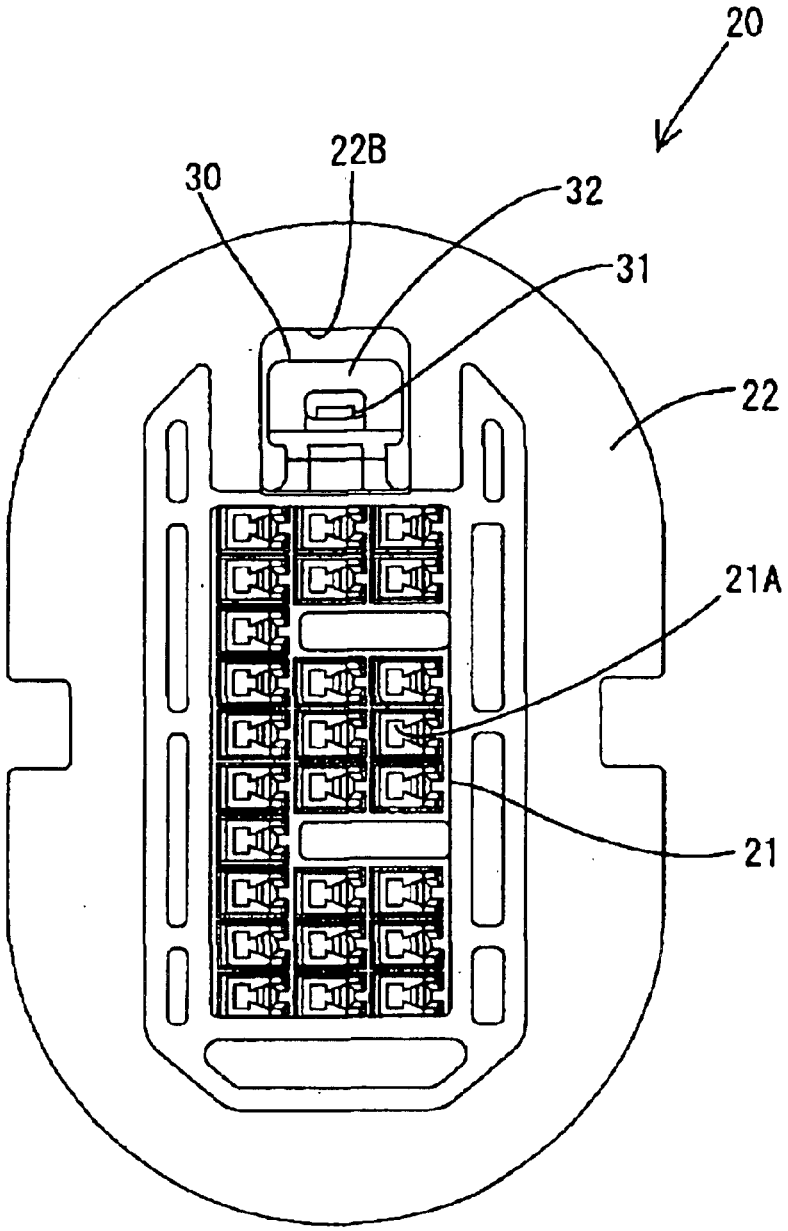
FIG. 4 is a rear view of the female housing.

The terminal-accommodating portion 21, as shown in FIG. 3, has different external height and width dimensions. More particularly, the terminal-accommodating portion 21 has left and right long sides 21B, 21C and upper and lower short sides 21D, 21E. Thus, the terminal-accommodating portion 21 has a vertically long substantially rectangular cross section. The jaw 22 has a vertically long substantially elliptical outer shape that substantially conforms to the shape of the terminal accommodating portion 21. Substantially parallel cuts 24 are made in the terminal-accommodating portion 21 at vertically spaced positions of the left long side 21C shown in FIG. 3. The shelves 17 in the receptacle 12 of the male housing 10 align with and fit in the cuts 24 when the male and female housings 10 and 20 are connected. As a result, upside-down connection of the housings 10, 20 is prevented due to the asymmetric arrangement of the shelves 17 and cuts 24.

Figure 6:
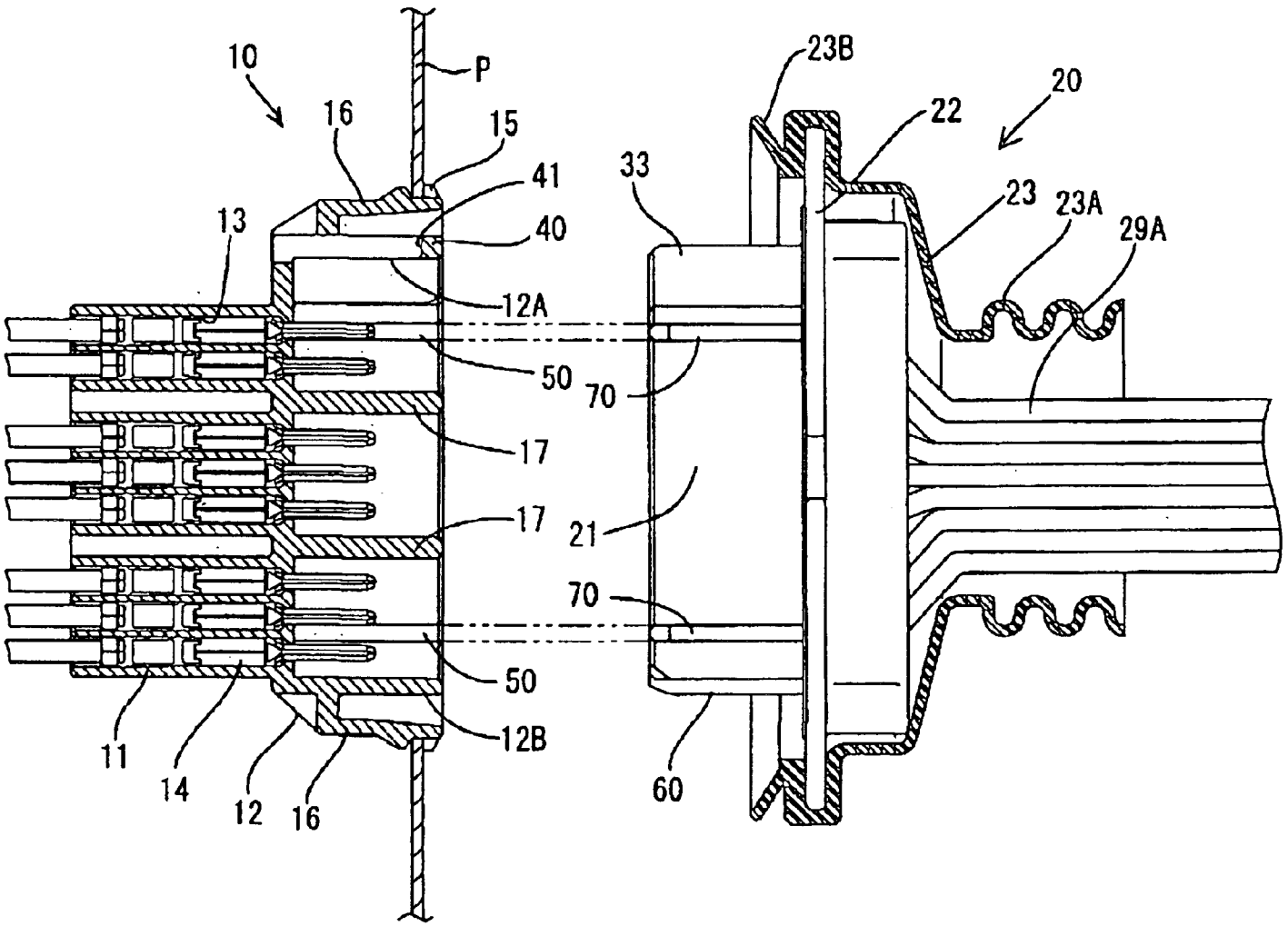
FIG. 6 is a section showing the state of FIG. 5 with a side surface of the female housing.

A lock arm 30 is cantilevered from a widthwise-middle of the upper short side 21D of the terminal-accommodating portion 21. The lock arm 30 projects up from the front end of the terminal-accommodating portion 21 and then extends back along the connecting direction CD through an introducing hole 22C in the jaw 22, as shown in FIG. 6. The extending end of the lock arm 30 reaches a position near the rear surface of the terminal-accommodating portion 21. A portion of the lock arm 30 exposed backward through the introducing hole 22C serves as an operable portion 32 for operating the lock arm 30. A lock 31 projects substantially at the middle of the lock arm 30 with respect to its extending direction and has a front surface aligned substantially normal to the connecting direction CD. The lock arm 31 contacts the front surface of the engaging portion 40 in the male housing 10 in the process of connecting the housings 10, 20, and the two housings 10, 20 are connected with a single stroke by a force created when the contact state is canceled. The two housings 10, 20 reach a proper connection position by this inertial force. The lock 31 engages the rear surface 51 of the engaging portion 40 at the connection position and the female housing 20 is locked into the male housing 10. Restricting walls 33 project from the upper short side 21D at opposite sides of the lock arm 30, as shown in FIG. 3. The restricting walls 33 prevent a wire or the like from entering a clearance between the lock arm 30 and the shorter side 21D and restrict inadvertent disengagement of the lock arm 30

Guidable portions 70 are formed on the longer sides 21B, 21C of the terminal accommodating portion 21 and can slide in contact with the connection guides 50 in the inner surfaces of the receptacle 12 when the two housings 10, 20 are connected. The guidable portions 70 are elongated projections that extend from the front end to the rear end of the terminal-accommodating portion 21 substantially in a connecting direction CD along which the terminal-accommodating portion 21 fits into the receptacle 12. The guidable portions 70 are provided on the longer sides 21B, 21C at a position near the upper shorter side 21D and at a position near the lower shorter side 21E and substantially face each other between the longer sides 21B, 21C.

Ribs 60 are formed at two positions near the opposite widthwise ends of the lower shorter side 21E of the terminal accommodating portion 21. The ribs 60 extend substantially parallel to the guidable portions 70 between the front and rear ends of the terminal-accommodating portion 21. Thus, the ribs 60 can slide in contact with the engaging grooves 51 in the inner surface of the receptacle 12 when the housings 10, 20 are connected.

The ribs 60 and the guidable portions 70 have slanted guiding surfaces at the front end of the receptacle 12 for smooth insertion into the engaging grooves 51 and the connection guides 50 at the start of the connection. The slanted guiding surfaces at the leading ends of the ribs 60 and the guidable portions 70 are disposed to engage the engaging grooves 51 and the connection guides 50 before the lock 31 contacts the engaging portion 40 in the connecting process. Engagement of the guidable portions 70 and the connection guides 50 ensures correct posture of the female housing 20 despite forces created when the lock 31 moves over the engaging portion 40.

The projecting distance of the ribs 60 is set so that the ribs 60 interfere with the opening edge of the receptacle 12. Thus, the front end of the terminal-accommodating portion 21 cannot contact the leading ends of the male terminal fittings 14 in the receptacle 12 regardless of the posture of the female housing 20 at the start of connection.

The connector is assembled by mounting the male terminal fittings 14 in the cavities 13 of the male housing 10, and mounting the female terminal fittings 29 in the cavities 21A of the female housing 20. Additionally, the grommet 23 is mounted on the female housing 20. The male housing 10 then is mounted on the inner surface of the panel P.

The two housings 10, 20 are arranged so that their engaging surfaces are opposed to each other, as shown in FIG. 6, and the terminal accommodating portion 21 of the female housing 20 is fit into the receptacle 12 of the male housing 10. The ribs 60 on the outer peripheral surface of the terminal accommodating portion 21 enter the engaging grooves 51 in the inner surface of the receptacle 12 at the start of the connection process. Thus, an inserting posture of the female housing 20 is corrected to a proper posture. The female housing 10 then is pushed by hand or by a jig or other pushing means so that the ribs 60 slide in close contact along the engaging grooves 51 and so that the guidable portions 70 slide in close contact along the connection guiding portions 50. When the terminal accommodating portion 21 reaches an intermediate position in the receptacle 12, the front surface of the lock 31 projecting from the lock arm 30 contacts the front surface of the engaging portion 40, thereby temporarily restricting the connection. The female housing 20 then is pushed with an operation force exceeding the connection resistance so that the contact state is canceled. Thus, as shown in FIG. 7, the housings 10, 20 are connected with a single stroke by an inertial force created upon canceling the contact state. As a result, the housings 10, 20 reach the proper connection position. Simultaneously, the lock 31 fits into the locking hole 41 and engages the rear surface of the engaging portion 40, and the front surface of the terminal accommodating portion 21 is held in contact with the back surface of the receptacle 12. Therefore, the female housing 20 is locked in the male housing 10, and the terminal fittings 14, 29 are connected electrically.

The lock 31 is on the shorter side 21D/21E on the outer peripheral surfaces of the terminal accommodating portion 21, and the two housings 10, 20 reach the connection position by the inertial locking of the lock 31. Forces created during the inertial locking tend to cause the female housing 20 to incline. However, the guidable portions 70 on the outer surfaces of the terminal accommodating portion 21 slide in contact with the connection guides 50 on the inner surfaces of the receptacle 12. Thus, the inertial locking will not cause the female housing 20 to incline, and the female housing 20 is guided smoothly to the connection position while in its proper posture.

The ribs 60 project from the shorter side 21E on the outer surface of the terminal accommodating portion 21 opposite the lock portion 31, and interfere with the opening edge of the receptacle 12 to avoid contact of the front end of the terminal accommodating portion 21 with the leading ends of the male terminal fittings 14. Thus, the front end of the terminal accommodating portion 21 cannot deform the leading ends of the male terminal fittings 14. As a result, contact reliability of the female and male terminal fittings 29, 14 is assured.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The guidable portions may be on either one or both of the shorter sides of the outer surfaces of the terminal accommodating portion. Further, the corresponding connection guides may be formed in either one or both of the upper and lower inner surfaces of the receptacle.

The guidable portions may be grooves in the outer surfaces of the terminal accommodating portion and the connection guides may be elongated projections on the inner surfaces of the receptacle.

The invention has been described with reference to a connector where an inertial connecting system uses cooperation between the lock 31 and the engaging portion 40. However, the invention is applicable to connectors where an inertial connecting system uses grommet(s) or sealing member(s) having ribs with a specific frictional resistance curve allowing an inertial connection of the two housings or comprising biased moving members increasing the connection resistance over a specified connection stroke or the two connector housings.

What is claimed is:

1. A connector, comprising:

a first housing with a terminal-accommodating portion for accommodating at least one terminal fitting and having different vertical and horizontal dimensions, and at least one lock on a shorter outer surface of the terminal-accommodating portion, and a second housing including a receptacle for receiving the terminal-accommodating portion, at least one mating terminal fitting connectable with the terminal fitting, and an engaging portion engageable with the lock when the terminal-accommodating portion is fit into the receptacle wherein:

at least one connection guide is formed on an inner surface of the receptacle of the second housing and extends in a fitting direction of the terminal-accommodating portion, at least one guidable portion is formed on an outer surface of the terminal accommodating portion of the first housing and disposed for sliding contact with the connection guide when the terminal-accommodating portion is fit into the receptacle, and at least one rib projects on a shorter surface of the terminal-accommodating portion opposite from the shorter surface that has the lock, the rib having a front end configured and disposed to interfere with an opening edge of the receptacle to prevent a front end of the terminal-accommodating portion from contacting a leading end portion of the mating terminal fitting in the receptacle.

2. The connector of claim 1, wherein the mating terminal fittings are arranged so that leading ends thereof project into the receptacle.

3. The connector of claim 1, wherein the first housing can be pushed into the second housing while the lock moves onto the engaging portion, and reaches a connection position by an inertial force when the terminal-accommodating portion is pushed a specified distance.

4. The connector of claim 1, wherein the first housing is locked with the second housing by engagement of the lock with a rear surface of the engaging portion.

5. The connector of claim 1, wherein the at least one guidable portion is formed on at least one longer surface of the terminal-accommodating portion.

6. The connector of claim 5, wherein leading ends of the at least one rib and the at least one guidable portion are disposed so that the rib and the guidable portion engage with a corresponding engaging groove and a corresponding connection guide before the lock contacts the engaging portion in a connecting process.

* * * * *